US006202867B1

(12) United States Patent
Di Blasi et al.

(10) Patent No.: US 6,202,867 B1
(45) Date of Patent: Mar. 20, 2001

(54) MODULAR STRUCTURE WITH MODULAR COMPONENT PARTS FOR MAKING SHELVES AND CLOSETS

(75) Inventors: Ottavio Di Blasi; Massimo Guizzardi, both of Milan (IT)

(73) Assignee: Terry Store - Age S.p.A., Milan (IT)

( * ) Notice: Subject to any disclaimer, the term of this patent is extended or adjusted under 35 U.S.C. 154(b) by 0 days.

(21) Appl. No.: 09/334,792

(22) Filed: Jun. 16, 1999

(30) Foreign Application Priority Data

Feb. 19, 1999 (IT) ..... MI99U0004

(51) Int. Cl.[7] ..... A47B 43/00

(52) U.S. Cl. ..... 211/188; 312/257.1; 312/263; 108/111

(58) Field of Search ..... 211/186, 188–189, 211/190, 187; 312/111, 128, 257.1, 265.2–265.6, 263; 108/64, 65, 106, 138, 139, 180, 192, 144.11, 147.11

(56) References Cited

U.S. PATENT DOCUMENTS

| | | | | |
|---|---|---|---|---|
| D. 383,014 | * | 9/1997 | Sagol | 211/188 X |
| 2,959,715 | | 11/1960 | Leonchick | 312/257.1 |
| 3,272,582 | | 9/1966 | Anderson et al. | 108/111 |
| 3,307,894 | | 3/1967 | Collier | 211/188 X |
| 3,567,300 | | 3/1971 | Mari | 108/111 |
| 3,669,033 | | 6/1972 | Murcia | 108/111 |
| 4,045,104 | | 8/1977 | Peterson | 312/257.1 |
| 4,099,815 | | 7/1978 | Cox et al. | 312/111 |
| 4,125,304 | | 11/1978 | Ebert | 312/257.1 |
| 4,125,338 | | 11/1978 | Lew | 312/263 |
| 4,418,627 | | 12/1983 | Baker | 108/91 |
| 4,585,283 | | 4/1986 | Redmon et al. | 312/257.1 |
| 4,630,550 | | 12/1986 | Weitzman | 403/205 |
| 4,768,845 | | 9/1988 | Yeh | 312/257.1 |
| 4,862,602 | | 9/1989 | Krill | 211/188 |
| 4,930,643 | * | 6/1990 | Flum | 211/188 |
| 4,998,023 | | 3/1991 | Kitts | 211/188 |
| 5,370,245 | * | 12/1994 | Tersch et al. | 211/189 |
| 5,372,262 | | 12/1994 | Benson et al. | 211/189 |
| 5,433,326 | | 7/1995 | Horian | 211/188 |
| 5,590,939 | | 1/1997 | Piontek | 312/263 |
| 5,722,544 | | 3/1998 | Williams | 211/188 |
| 5,975,660 | | 11/1999 | Tisbo et al. | 312/263 |
| 5,988,439 | | 8/1999 | Ellsworth | 403/231 |

* cited by examiner

*Primary Examiner*—Daniel P. Stodola
*Assistant Examiner*—Jennifer E. Novosad
(74) *Attorney, Agent, or Firm*—Herbert Dubno

(57) ABSTRACT

A modular shelving system has modular members in which upper and lower links along corresponding sides of the rectangle are joined by uprights in the form of pairs of columns whose pins engage in holes of the links. The holes are provided in pairs at each corner so that four equivalent holes are disposed in a row when two modular members lie in the same plane and adjoin at the respective corners. The columns can interconnect the modular members.

15 Claims, 5 Drawing Sheets

MODULAR STRUCTURE WITH MODULAR COMPONENT PARTS FOR MAKING SHELVES AND CLOSETS

BACKGROUND OF THE INVENTION

1. Field of the invention

The present invention relates to a novel modular shelving and cabinet structure which is particularly easy to install and use.

2. Description of the Prior Art

The present shelving and cabinet modular structures, which are applied to walls, have the drawback of being dimensionally rigid and therefore difficult to be subsequently expanded. The conventional structures also have the drawback of being composed of a considerable number of component parts which make these structures difficult to assemble and more expensive.

The aim of the present invention is to provide a novel modular structure with modular component parts, for making shelvings and cabinets, which, contrary to the conventional structures, is dimensionally flexible and allows to subsequently add further shelving and cabinets to the former ones.

A further aim of the invention is to provide a novel modular structure with modular component parts for making shelves and cabinets, which is extremely simple to assemble both vertically and horizontally, as well as stable and with a great capacity.

SUMMARY OF THE INVENTION

The above and other aims are achieved by a modular structure with modular component parts for making shelves and cabinets as claimed in the characterizing part of claim 1.

Further preferred embodiments of the invention are claimed in the dependent claims.

With respect of the conventional modular shelving and cabinet structures, the structure according to the present invention offers the advantage of allowing to lay the cabinet members and/or the shelf members one upon the other and/or to lay them side by side, also at different times thus maintaining the initial investment.

The structure according to the invention also allows to expand the system both horizontally and vertically by means of rapid and simple operations, requiring a minimum number of component parts thus optimizing the storing capability and providing a high stability and capacity for this type of structures

BRIEF DESCRIPTION OF THE DRAWINGS

Further characteristics and advantages of the invention will be more apparent by the description of a preferred but not exclusive embodiment of the structure according to the invention illustrated, by way of indicative but not exclusive example in the enclosed drawings wherein.

DESCRIPTION OF THE PREFERRED EMBODIMENTS OF THE INVENTION

Figure 1:
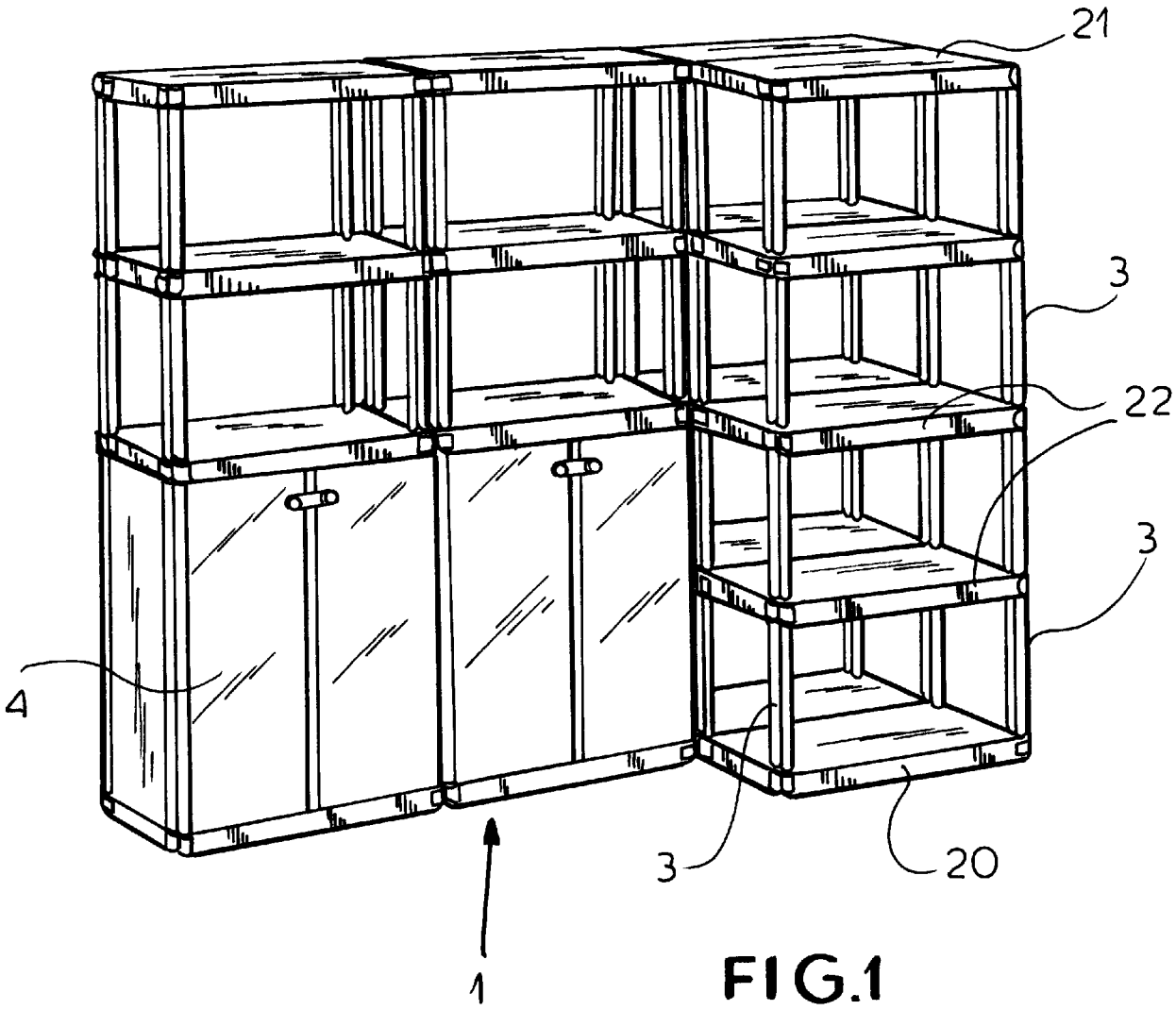
FIG. 1 is a perspective view of a composition of shelvings and cabinets made by the structure according to the invention.

In the embodiment shown in FIG. 1, the modular structure according to the invention has been used to provide a piece of furniture 1 formed by a composition of cabinets and shelvings composed by the base member 2 defining a shelf 22, a base 20 and a cover 21, supported by uprights 3.

Preferably, all the component parts of the illustrated structure are made of plastics even though the use of other materials is not precluded.

Figure 2:
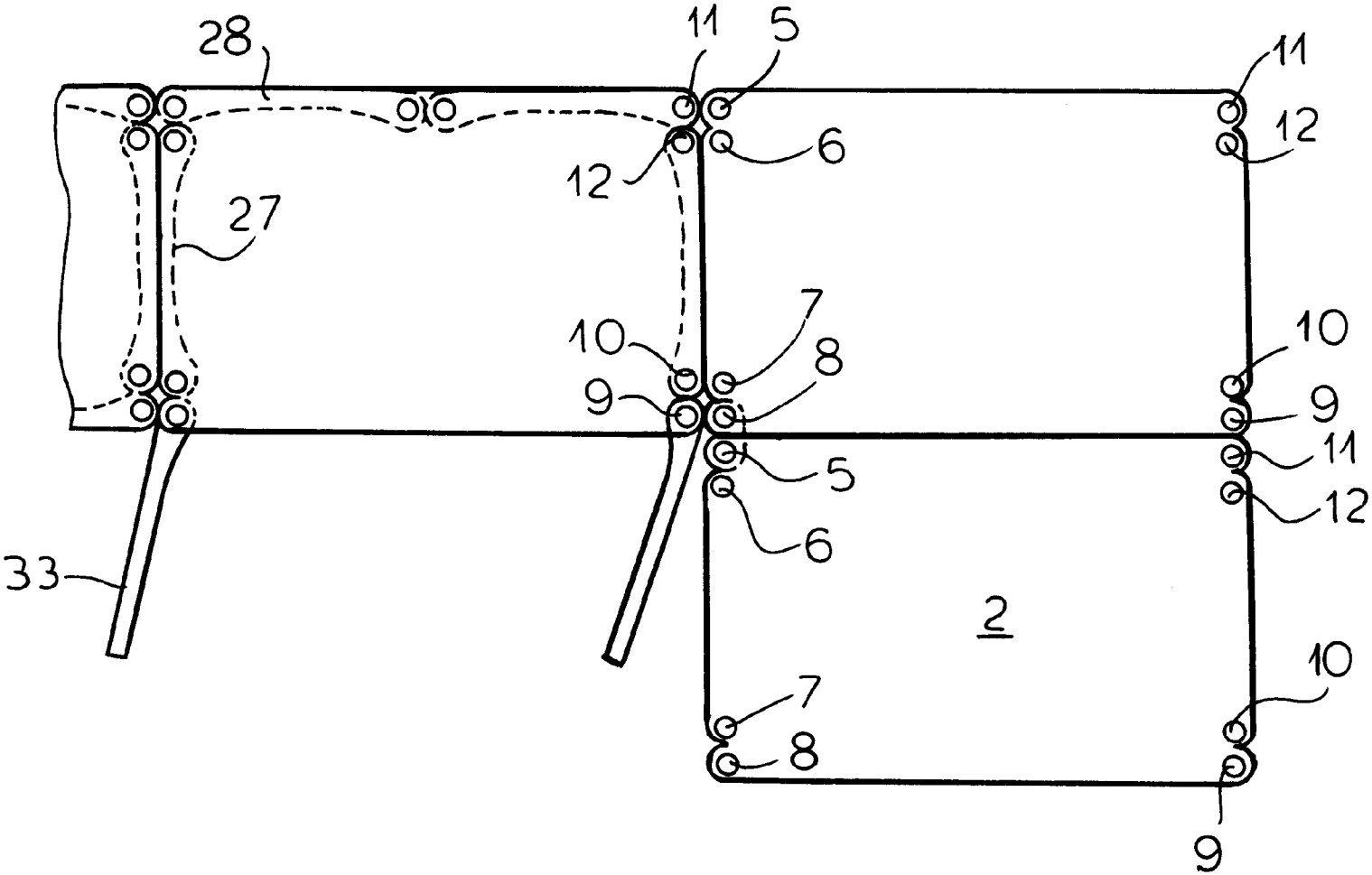
FIG. 2 is a top plan view of the structure of FIG. 1.
Figure 3:
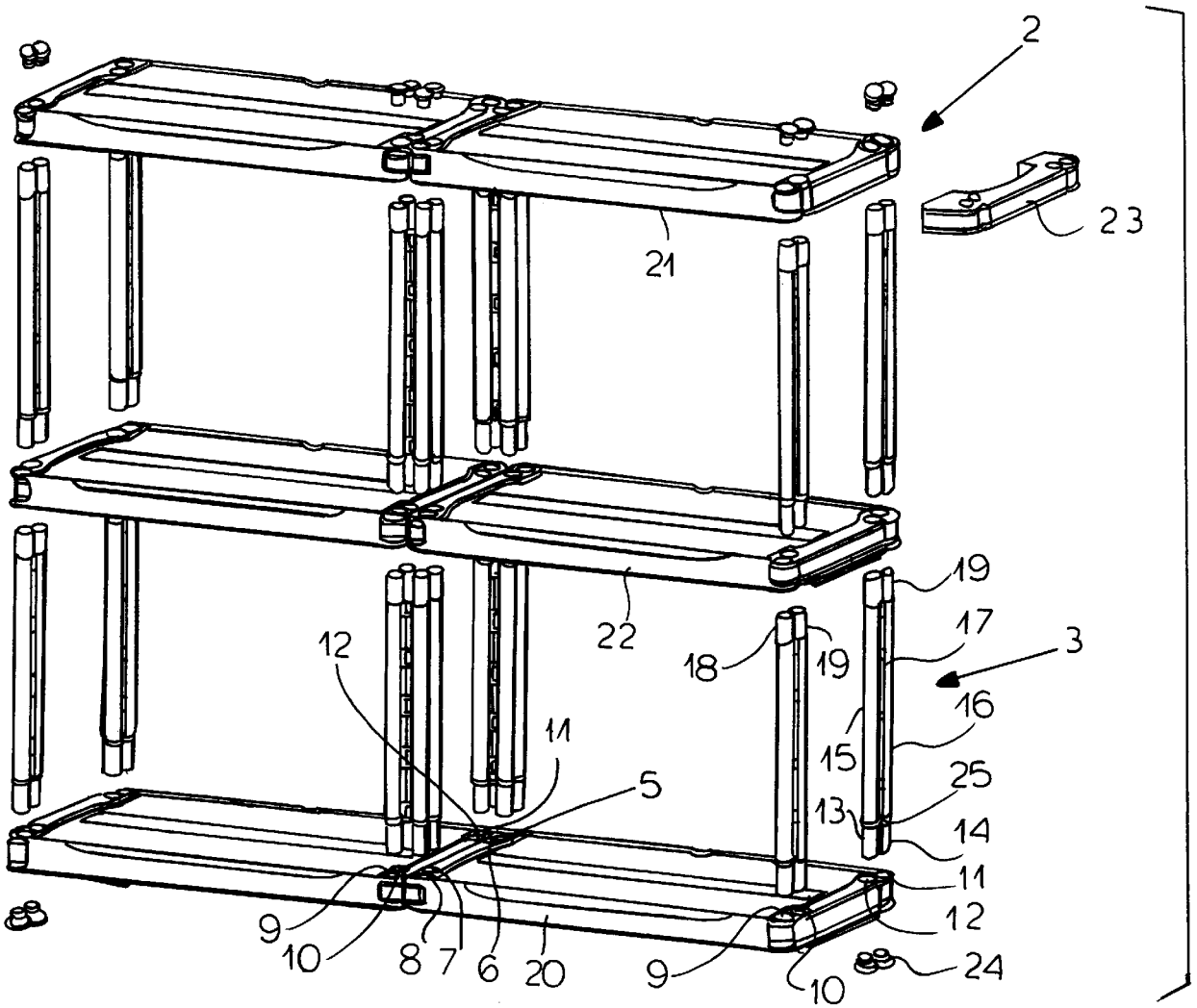
FIG. 3 is an exploded view of the shelving member of the composition of FIG. 1.

As shown in FIGS. 2 and 3, the intermediate shelves 22, the bottoms 20 and the covers 21 are constituted by the same modular member 2 having a substantially rectangular shape and provided with twin holes, respectively 5-6, 7-8, 9-10, 11-12, at its corners. The lower ends 13 and 14 of uprights 3 are inserted inside the twin holes and are constituted by pillars 15 and 16 which are joined by rigid cross links 17 in order to be parallel and spaced apart by a distance equal to the distance between each twin hole. The same pillars are provided with upper ends 18, 19 inserted in corresponding holes in the upper shelf.

The uprights are assembled by inserting the ends inside the shelf twin holes 5-6, 7-8, 9-10, 11-12.

According to an important feature of the present invention, the pillars 15, 16 and twin holes 5-12 on the modular members 2 allow to rapidly and stably superimpose and/or lay side by side different shelf members 20, 21, 22 as shown in FIGS. 2 and 3.

To this end, the modular members 2 may be coupled, on the horizontal plane, by inserting the uprights 3 across the connecting lines between the same members 2. In this case, the pillar 15 of an upright is inserted in the outermost hole of the twin holes of a first modular member 2, while the pillar 16 of the same upright is inserted in the outermost hole of the corresponding twin holes of the adjacent modular member. In this case, for example, the lower ends 13, 14 of an upright 3 are inserted in holes 11, 5 respectively, of two adjacent modular members 20 , while the upper ends 18, 19 of the same upright 3 are inserted in the corresponding holes 11, 5 of the upper shelves 22 (FIG. 3)

A mutual connecting bridge is thus provided, on the horizontal plane, between adjacent modular members 2, by using to this end the same uprights 3 that serve for expanding the piece of furniture 1 vertically.

In order to provide greater stability to the piece of furniture, the above described twin holes in the corners of the modular members 2 also allow the insertion of two pillars 3 at a same corner on the mutual connection section between two adjacent members 2 (FIG. 3). In this manner, each modular member is anchored at eight points and is therefore extremely stable and adapted to carry a considerable weight.

The two shorter sides of the modular members 2 are laterally closed by a stiffening profile 23 which is slidingly inserted inside the members 2 and is provided with holes in the same position of the holes 5–12 described above. Caps 24 are provided for closing the holes that are not used for the connections between the modular members 2. The ends of the uprights 3 are provided with a circular shoulder 25 which, once the structure is assembled, rests on the surface of the members 2 which is arranged around the holes 5–12.

Figure 4:
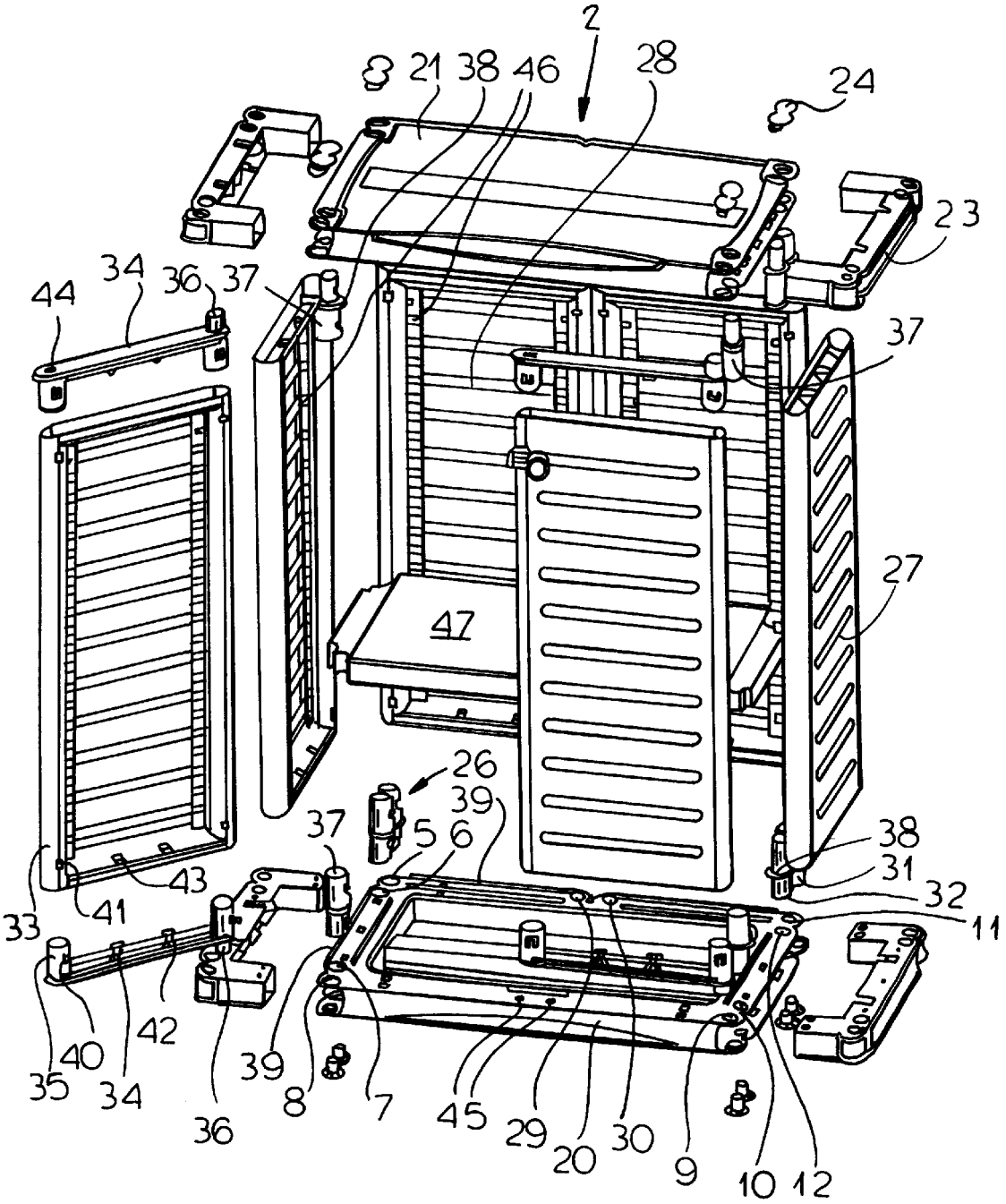
FIG. 4 is an exploded view of the cabinet member of the composition of FIG. 1.

The modular members 2, together with the side members 23 used for providing the above described shelving, may be used for constructing cabinets 4 of FIGS. 1 and 4. In this case, the mutual connection, on the horizontal plane, between adjacent modular members 2, is provided by means of twin pins 26 having a construction similar to the above described construction of the uprights 3 with the difference that the pins are considerably shorter.

For the above reason, the twin pins 26 allow to expand the structure horizontally, according to a system similar to the system described above for the uprights 3. These pins 26 are in fact arranged with their ends across adjacent modular members 2 and inserted in respective holes at the corners.

The vertical expansion of the cabinet 4 which is based on said pins 26 is instead achieved by means of wings 27, 28 and 33 of the cabinet. More particularly, adjacent rear wings 28 are joined together and fastened to respective bottom modular member 20 and cover modular member 21, at their junction line, by means of a twin pin 26 inserted on one hand into holes 29, 30 provided on the corresponding longitudinal side of the same modular member 20 and 21, and, on the other hand, in respective holes (not illustrated) provided at the ends of the same wings.

The "L" shaped mutual connection between the rear fixed wings 28 and the respective side fixed wing 27 is provided by engaging a peg 31 of the twin pin 26 into the rear wing and the remaining peg 32 into the side wing. The other end of these pegs is instead arranged into holes 5, 6 and 11, 12 of the modular members 2, in the manner already described with reference to FIGS. 1 and 3.

The side wing 27 is fastened to the member 2 also by a single pin 37 arranged, on one hand, in the hole provided on the remaining end of wing 27 and, on the other hand, into the innermost hole 7, 10 of the respective modular member 2.

The twin pins 26 and the single pin 37 are also provided with peripheral annular shoulder 38 having the same height of ridges 39 that function for centering the position of the fixed wings on the modular member 2.

The mobile wings 33 are provided with closure end caps 34 that are in turn provided, on the inner side, with pegs 35 insertable in the wing. A pin 36 is provided on the outer side of caps 34, i.e. on the side opposite to that of pegs 35. Pin 36 is arranged in the respective outer hole 8, 9 of modular member 20 or 21 of the cabinet thus defining a hinge for the wing acting as a door.

The pegs 35 are further locked in this wing by an elastic tang 40 projecting from their side surface and snapping inside a slot 41 formed in the wing. The wing caps 34 are also provided with hollow cylinders 42 adapted to lock on the body of the wing at corresponding cylindrical seats 43.

A projecting tang 44 is provided on the ends of caps 34 opposite to the ends provided with the outer pegs 34. The projecting tang 44 is adapted to snap on the closure of wing 33 in corresponding seats 45 provided on the sides of the modular members 20 and 21 where the wing closes.

Figure 5:
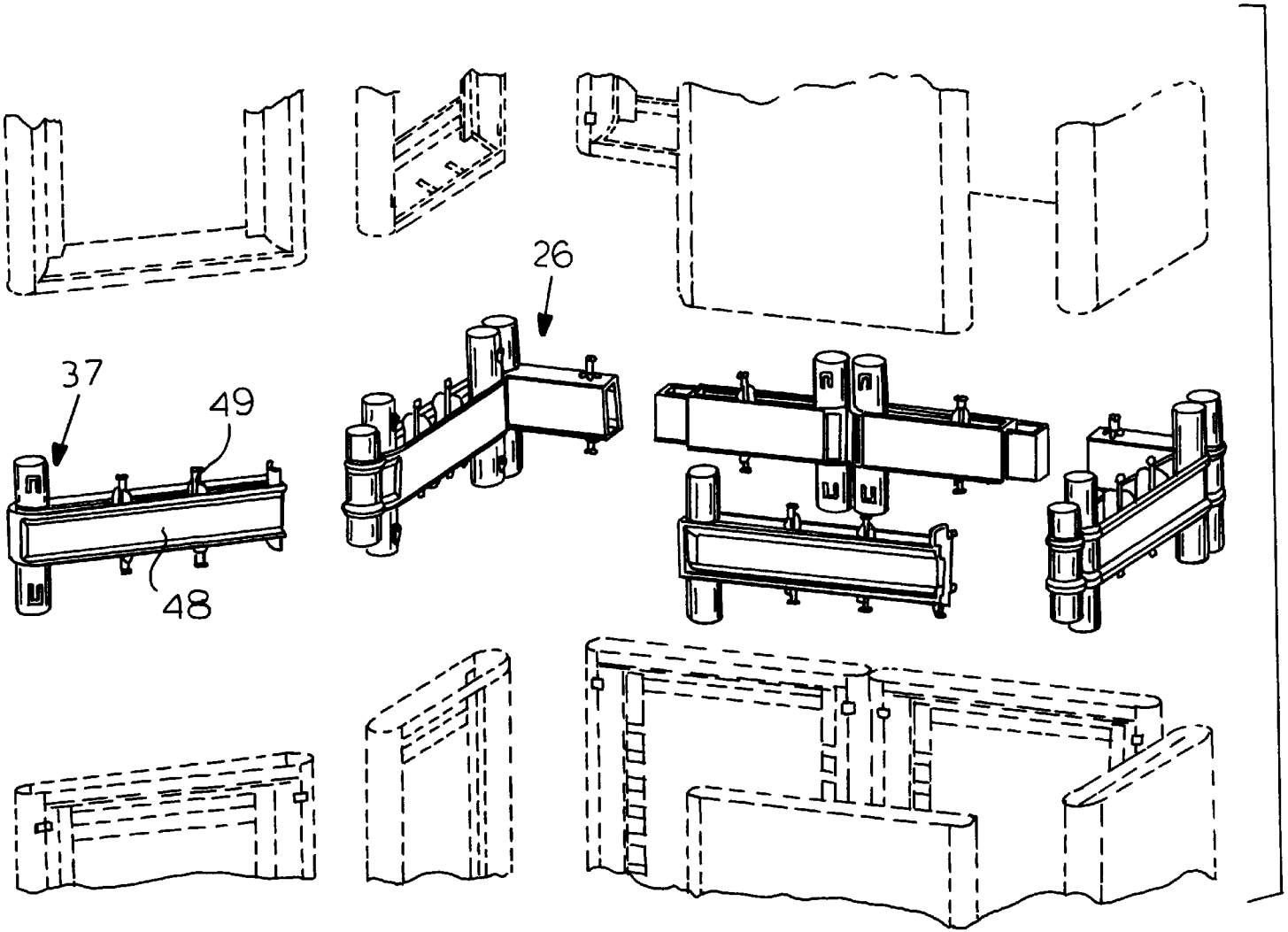
FIG. 5 is a perspective view of the links that by being inserted in adapted seats in the doors of the cabinet, allow to provide a member which is twice the high of the base member.

Racks 46 are also provided for supporting shelves 47 of the cabinet 4. In the embodiment shown in FIG. 5, pins 26 and 37 are made integral with a connecting strip 48 provided with cylinders 49 and functioning in a manner similar to that of cap 34 described above.

As shown in FIG. 1, the shelves of FIG. 3 and the cabinets of FIG. 4 may be combined together to form a composition wherein the modular members 2 form the intermediate shelves 22 as well as the bottom 20 and the cover 21 of both the cabinets and of the shelving. In this embodiment, the combined engagement of the uprights 3 and of the single and twin pins 26, 37 inside holes 5–12 of the modular elements 2 allow to superimpose and/or to lay side by side several cabinets 4 and shelving 22 thus obtaining a composite structure as the one shown in FIG. 1.

The above described composite structure allows to expand the shelving both horizontally and vertically, also at different times, and by using modular components that make the assembling easy and reduce the overall production costs.

The modular structure according to the invention may be modified within the scope of the following claims. In fact, as said above, the materials may be different from plastics. Also the shape of modular members may be different from the shape illustrated and the structure mutual connecting means may be substituted with functionally equivalent connecting means.

What is claimed is:

1. A modular shelving system composed of a plurality of rectangular modular members each having a pair of upper links and a pair of lower links along corresponding sides of the rectangular members and uprights extending between the upper and lower links at each of said sides, said upper and lower links being formed at each end with a pair of spaced-apart holes whereby pairs of holes are provided at each of the corners of each said modular member and, upon coplanar alignment of two of said rectangular modular members, four of said holes of the two rectangular modular members are aligned at adjacent corners of the rectangular modular members, said uprights each including at least two interconnected columns defined by pins and fitted into holes of the two of said rectangular modular members at adjacent corners to hold said rectangular modular members together.

2. The modular shelving system defined in claim 1 wherein at least some of said rectangular modular members are formed with upper and lower shelves separated by said uprights.

3. The modular shelving system defined in claim 2 wherein at least some of said uprights include four interconnected columns defined by pins which are fitted into holes of at least three of said rectangular modular members adjoined at respective corners of said three modular members.

4. The modular shelving system defined in claim 2 wherein each said modular member comprises an inner shelf in the shelving system fastened at 8 points to respective ones of said columns.

5. The modular shelving system defined in claim 2 wherein each of said pins is formed with a circular shoulder at an end of each of said pins, each of said shoulders resting on a surface of the respective modular member and lying around a hole which receives the respective pin.

6. The modular shelving system defined in claim 2, further comprising twin pins shorter than said uprights to thereby lock to fixed wings of cabinets formed by respective said rectangular modular members of the shelving system.

7. The modular shelving system defined in claim 6 wherein said twin pins are engageable in said holes of said modular members which form a bottom and top of one of the cabinets and in holes provided at the ends of said fixed wing.

8. The modular shelving system defined in claim 7 wherein racks are provided for supporting shelves inside the cabinet.

9. The modular shelving system defined in claim 6 wherein each of said twin pins is provided with a pair of spaced apart pegs for locking to rear fixed wings of one of the cabinets.

10. The modular shelving system defined in claim 9 wherein one of said pairs of pegs is locked on the rear fixed wing while the other of said pairs of pegs is engaged in a side fixed wing adjacent the rear fixed wing.

11. The modular shelving system defined in claim 10 wherein a surface of one of said modular members on which said rear fixed wings rest is provided with centering ridges for said wings, said twin pins being provided with peripheral annular shoulders having the same height as said ridges.

12. The modular shelving system defined in claim 11, further comprising a pair of movable wings pivotally connected by said twin pins to said modular members, each of said movable wings being formed with a pair of end caps having pegs provided with elastic tongs for snap locking inside a respective slot of a respective one of said movable wings.

13. The modular shelving system defined in claim 1 wherein said pins each are formed with a circular shoulder.

14. The modular shelving system defined in claim 1, further comprising caps for closing holes of said modular members which are unused in the shelving system.

15. The modular shelving system defined in claim 1 being entirely made of plastic.

* * * * *